United States Patent [19]

Sawyer

[11] Patent Number: 5,074,548

[45] Date of Patent: Dec. 24, 1991

[54] WALKING STILTS

[76] Inventor: James E. Sawyer, 700 N. St. Mary's St., Ste. 1400, San Antonio, Tex. 78205

[21] Appl. No.: 504,098

[22] Filed: Apr. 3, 1990

Related U.S. Application Data

[63] Continuation of Ser. No. 306,388, Feb. 6, 1989, abandoned.

[51] Int. Cl.[5] ..... A63B 25/00

[52] U.S. Cl. ..... 272/70.2

[58] Field of Search ..... 272/70.1, 70.2, 73, 272/DIG. 4; 136/65, 72

[56] References Cited

U.S. PATENT DOCUMENTS

| | | | |
|---|---|---|---|
| 680,454 | 8/1901 | Garretson | 272/70.1 |
| 1,427,030 | 8/1922 | Stephens et al. | 272/70.2 |
| 3,612,460 | 10/1971 | Smith | 272/70.2 |
| 3,660,920 | 5/1972 | Spina | 40/129 |
| 3,667,755 | 6/1972 | Manning | 272/70.1 |
| 3,756,596 | 9/1973 | Black, Jr. | 272/70.1 |
| 3,782,720 | 1/1974 | Thorson | 272/70.1 |
| 3,831,937 | 8/1974 | Jones | 272/70.1 |
| 4,032,140 | 6/1977 | Davis et al. | 272/70.1 |
| 4,071,243 | 1/1978 | Fink | 272/70.1 |
| 4,079,929 | 3/1978 | Varnum | 272/DIG. 4 |
| 4,305,578 | 12/1981 | Disbrow et al. | 272/73 |
| 4,415,063 | 11/1983 | Hutchison | 182/230 |
| 4,570,926 | 2/1986 | Ensmenger | 272/70.1 |
| 4,711,446 | 12/1987 | Nielsen et al. | 272/70.1 |

FOREIGN PATENT DOCUMENTS

| | | | |
|---|---|---|---|
| 1030365 | 6/1953 | France | 272/70.2 |
| 0609382 | 9/1948 | United Kingdom | 272/70.1 |

*Primary Examiner*—Stephen R. Crow

*Attorney, Agent, or Firm*—Hubbard, Thurman, Tucker & Harris

[57] ABSTRACT

An adjustable stilt as disclosed consisting of first and second tubular elements, the second tubular element being slideably disposed with the first. The tubular elements have suitable holes formed therein through which a clevis pin or other suitable device may be inserted to prevent relative longitudinal movement between the first and second tubular elements. A step is provided near the lower portion of the first tubular element, having a mounting portion engageable with the first tubular member, a horizontal top portion for supporting the user's foot, and a vertical foot brace portion which engages the side of the user's foot to prevent the step from inadvertently rotating.

11 Claims, 3 Drawing Sheets

WALKING STILTS

BACKGROUND OF THE INVENTION

This invention relates generally to stilts and to an improvement in the construction and design of the historic stilt.

While there have been many designs and different constructions of stilts many claiming to be adjustable; none of the prior stilts have proved to be reliable and as easy to use as the present invention.

In designing the construction of the invention, various alternative construction designs were considered. The invention as claimed herein was tested and determined to be a vast improvement over any known design or construction available for sporting and recreational purposes. In addition, the subject invention is intended for use by both children and adults. Therefore, they are built to withstand the additional weight and stress of an adult. This results in a stronger and safer product for all.

SUMMARY OF THE INVENTION

While simple in design, the invention is considered up-scale in design and construction quality. The overall design and construction is with rounded corners and hidden or padded hardware and corners, with concealment of protrusions/sharp edges and snag points such that no sharp corners, edges or obstacles are exposed that might injure. The ability to adjust the height of the invention, quickly and easily without tools, increases the utility of the invention.

The design of the stilt step with an extended flat vertical surface perpendicular to the pole on the pole side of the top of the step which fits against the user's foot preventing the stilt pole from rotating on its axis while the user is on the stilt. This element together with the width, and tread design of the step, provides a positive grip on the users foot without having to rely on straps, lips, or any other gimmick on the step, which might entangle the user's foot, causing the user to fall and injure themselves.

The step is formed so as to wrap around the pole portion of the invention providing a griping action on the pole, thereby integrating the step and pole, resulting in increased strength and safety of the invention. The wrap around design of the step allows the use of a clevis pin or detent pin instead of nut and bolt to fasten the step to the pole. To be able to use pins, instead of nuts and bolts, means that no tools are required to adjust the height of the stilt. Thus, the time required to adjust the stilt is reduced to a minimum. This greatly enhances the utility of the stilt to the user.

The adjusting mechanism of the invention step uses a clevis pin and ring, or a detention pin, which are both safe and quick to remove for adjusting the height. Height adjustment is accomplished by constructing the vertical pole portion of the invention of two round tubes, one of which is smaller in diameter and fits within the bottom of the upper or outside pole. The upper (outside) pole has a hole through it that is lined up with holes in the lower (inside) pole at the desired height. A clevis pin or detent pin is pushed through the gripping side of the step, through the upper pole hole, through two holes on the lower pole of the same elevation at the desired height, through the hole in the opposite side of the upper pole, and then through the horizontal receiving hole in the step.

This invention is designed with the intention that both children and adults would use them. The key elements considered in the design of this invention are: (A) safety, (B) a height adjustment mechanism that is easy to operate, (C) durability, (D) strength, (E) light weight and (F) an up-scale look.

The following detailed description when read in connection with the accompanying drawings illustrating the invention, will make the advantages and objective of the invention self evident.

DETAIL DESCRIPTION OF THE DRAWINGS

While the drawings show only one stilt for illustration purposes. In use, two stilts are required by the user, with both stilts being identical.

Figure 1:
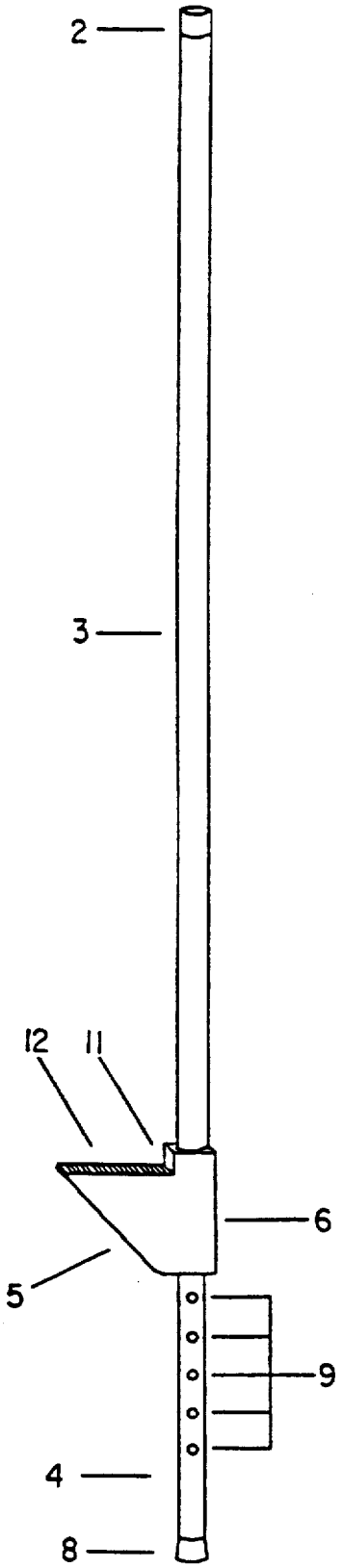
FIG. 1 is a prospective view of the stilt.

FIG. 1 shows a stilt having a upper pole (3) and a lower pole (4). The lower pole (4) fits into the upper pole (3). A protective soft cap (2) is placed over the top end of the upper pole (3) to protect the user from the sharp edges around the top of the upper pole (3). A rubber foot (8) is placed on the bottom of the lower pole (4) to provide traction while walking on the stilts as well as protection from any sharp edges around the bottom of the lower pole (4).

A molded step (5), of light weight material, is shown attached to the upper pole (3) by a clevis pin (6) and held in place by a ring or cotter pin (alternatively the step (5) can be held in place by a detention pin which does not require a cotter pin). Step (5) is designed with a vertical foot brace (11) to prevent the upper pole (3) and lower pole (4) from rotating on their axis while being used, increasing the utility and safety of the stilt. The top of the step (5) has a tread design to increase the traction for the user's foot. These features increase the safety of the stilt because they eliminate the necessity for the use of any type of straps, lips or other gimmicks which can entangle the user's foot, thereby increasing the safety of the stilt.

Figure 2:
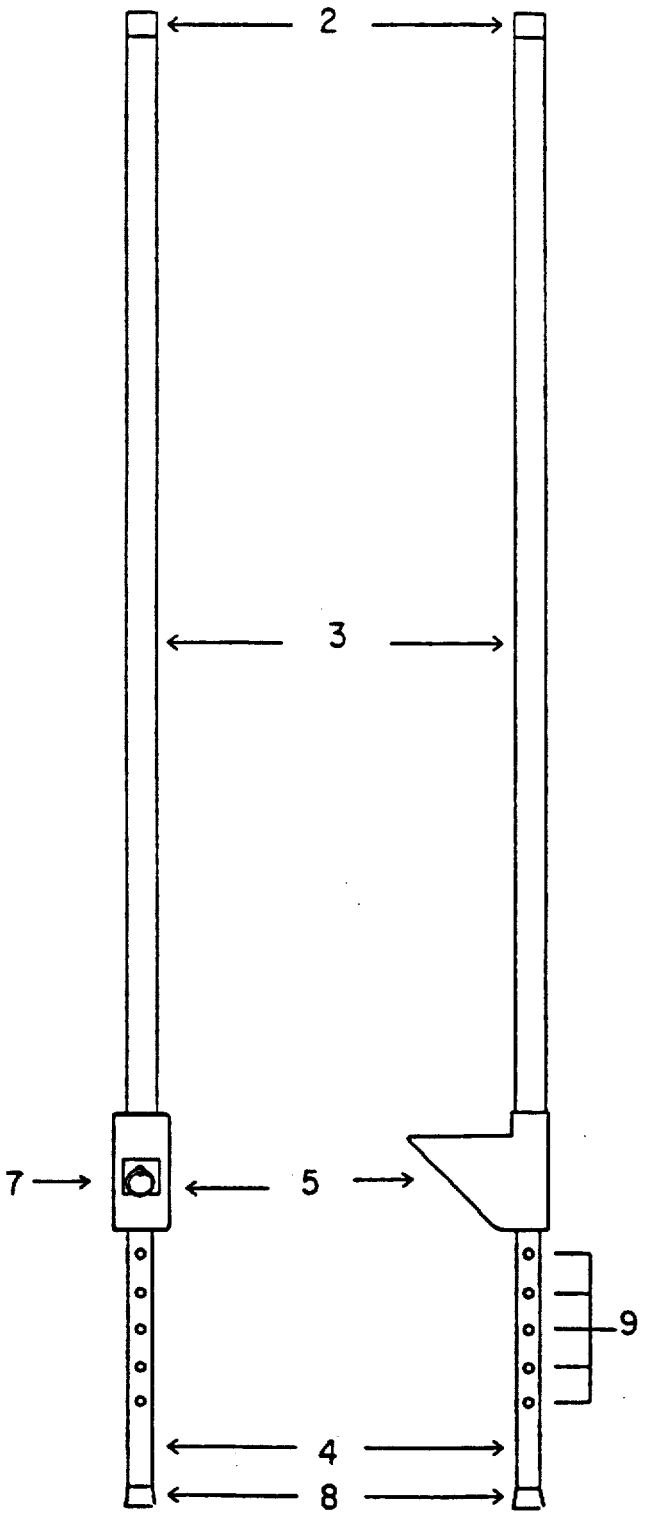
FIG. 2 is a front and side view of the stilt.

FIG. 2 shows a front and side view of the stilt.

Figure 3:
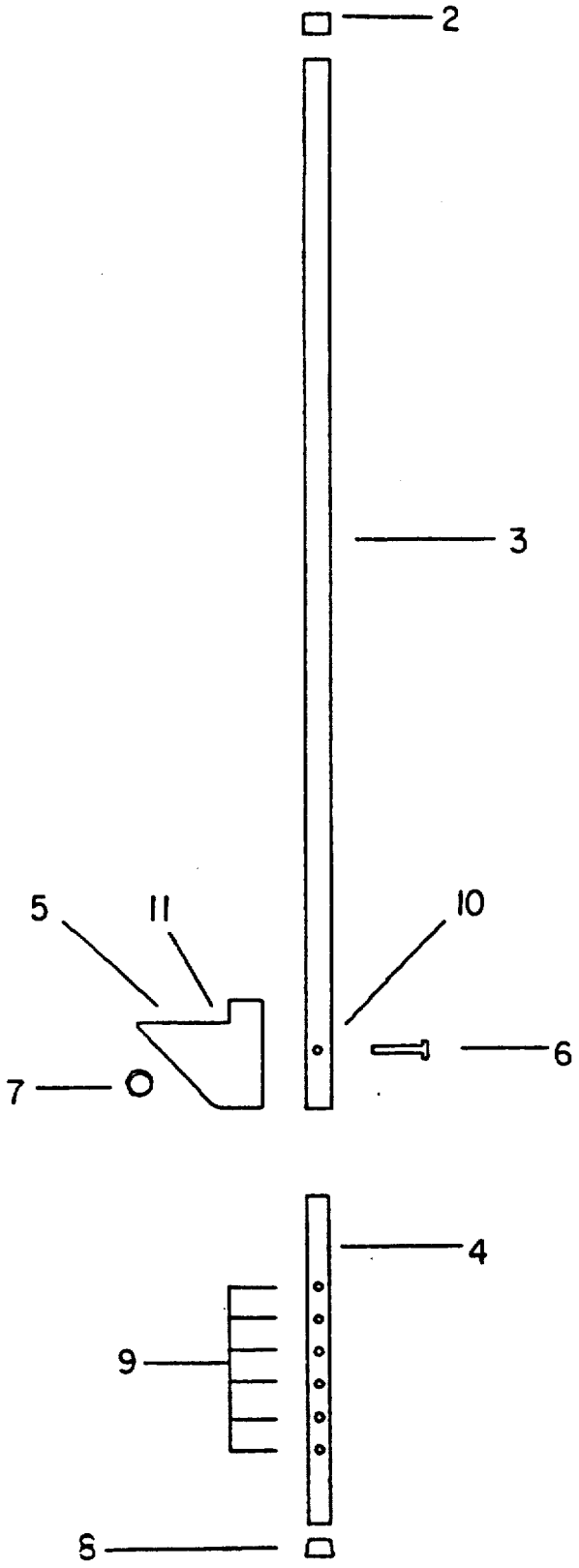
FIG. 3 is a exploded view showing all the parts of the stilt.

FIG. 3 shows an exploded view of the parts of the stilt.

1. the stilt in its entirety.
2. top cap.
3. upper pole.
4. lower pole.
5. step.
6. clevis pin.
7. ring or cotter pin.
8. foot pad.
9. adjustment holes for the lower pole.
10. adjustment holes for the upper pole.
11. step vertical foot brace.

Figure 4:
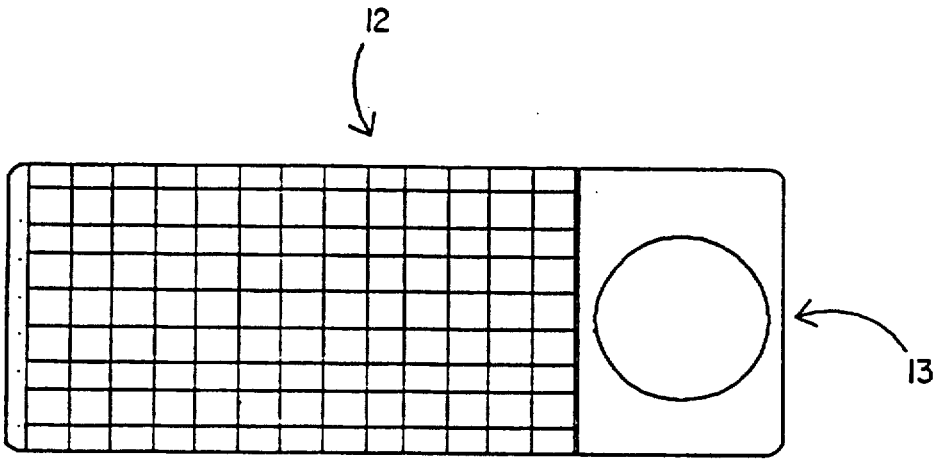
FIG. 4 is a top plan view of the step of the stilt.
Figure 5:
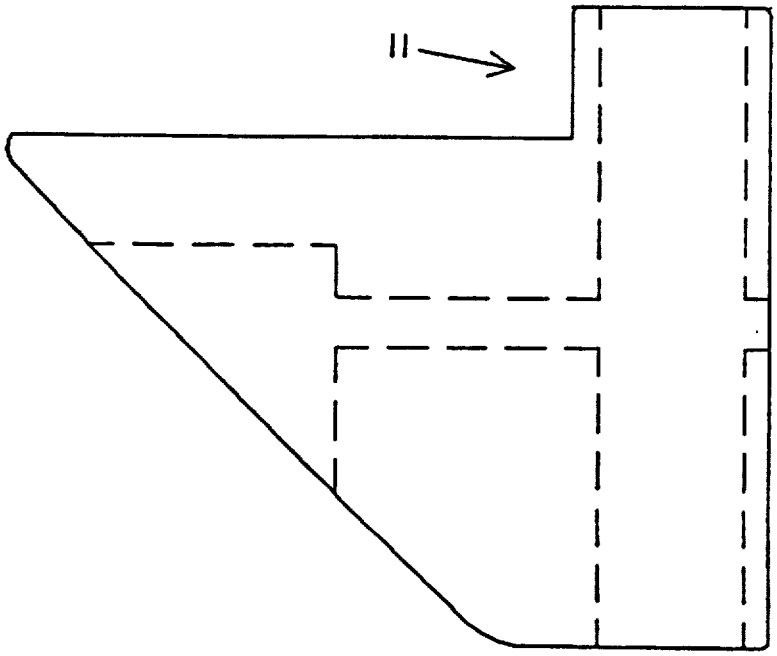
FIG. 5 is a front elevational view of the step of the stilt.
Figure 6:
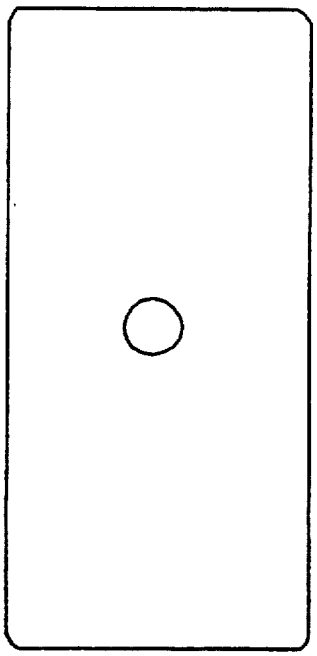
FIG. 6 is side elevational view of the step of the stilt.

FIGS. 4–6 illustrate top, front, and side views, respectively, of the step 5 of the stilt. The vertical foot brace (11) prevents the upper pole (3) and lower pole (4) from rotating on their axis while being used, increasing the utility and safety of the stilt. The top of the step has a tread design (12) to increase the traction for the user's foot. These features eliminate the necessity for the use of any type of straps, lips or other gimmicks which can entangle the user's foot thus increasing the safety of the stilt. The molded design (13) of the step around the upper pole (3) adds strength and stability to the step and allows the use of a quick connect pins instead of nuts and bolts. Although nuts and bolts could still be used.

I claim:

1. Stilt apparatus having enhanced user safety and foot stability, said stilt apparatus comprising:

an elongated pole structure positionable in a generally vertically extending operating orientation in which a lower end of said pole structure is engageable with a horizontal support surface such as the ground; and a step member, secured to said pole structure and positioned upwardly of its lower end, upon which a user of said stilt apparatus may stand, on one foot, when said pole structure is in its operating orientation, said step member including:

a first portion having a length extending transversely to said pole structure in a first direction, an inner end adjacent said pole structure, an outer end positioned outwardly of said inner end and defining an outer end of said step member, and an essentially flat upper side surface adapted to engage and support the bottom of the user's foot, said upper side surface defining the uppermost boundary of said first portion whereby said first portion permits, without obstruction, a rapid outward removal of the user's foot therefrom, and a second portion extending upwardly from said inner end of said first portion along a side portion of said pole structure, said second portion having an essentially flat outer side surface which faces in said first direction and extends substantial distances laterally beyond opposite sides of said pole structure, said outer side surface defining on said step member a horizontally extended bracing surface against which a side of the user's foot may be placed to substantially inhibit undesirable relative pivoting between the user's foot and the pole structure, about a generally vertical axis, during use of said stilt apparatus.

2. The stilt apparatus of claim 1 further comprising:

means for selectively adjusting the length of said pole structure.

3. The stilt apparatus of claim 2 wherein:

said pole structure includes upper and lower longitudinal sections which may be telescoped to form an axially overlapped area thereon of selectively variable length, and said means for selectively adjusting the length of said pole structure include opening means formed transversely through said upper and lower pole structure sections and variably alignable along their axially overlapped area, and locking means removably insertable into said opening means to operatively interlock said upper and lower pole structure sections and selectively vary the length of their axially overlapped area.

4. The stilt apparatus of claim 3 wherein:

said step member is removably securable to said pole structure, said second portion of said step member has an opening extending therethrough in a direction transverse to the length of said step member and configured to slidably and coaxially receive the axially overlapped portion of said upper and lower pole structure sections, and opposed openings spaced apart along an axis parallel to the length of said first portion, and said locking means are additionally insertable through said opposed openings in said second portion of said step member to removably secure said step member on said pole structure.

5. An adjustable stilt comprising:

a first tubular element having a lower end;

a second tubular element telescoped with said first tubular element, a portion of said second tubular element extending downwardly beyond said lower end of said first tubular element;

adjustment means for selectively adjusting the length of said portion of said second tubular element extending downwardly beyond said first tubular element, said adjustment means being further operative to releasably secure said first tubular element to said second tubular element and prevent relative axial movement therebetween; and a step carried by said tubular elements and positioned near said lower end of said first tubular element, said step including:

a mounting portion secured to at least one of said tubular elements, a horizontal top portion extending transversely outwardly from said tubular members, said top portion being operative to support a user's foot during use of said stilt; and a substantially flat vertical foot brace surface formed on said mounting portion and extending transversely upwardly from said horizontal top portion, said foot brace surface horizontally extending substantial distances laterally beyond oppositely disposed side portions of the tubular members and being operative to engage a side portion of the user's foot and substantially inhibit unintended horizontal rotation of said step relative to the user's foot supported on said top portion during use of the stilt.

6. The adjustable stilt of claim 5 wherein:

said first and second tubular elements have stilt length adjustment holes formed transversely therethrough, at least one hole in one of said tubular elements being alignable with a selected one of an axially spaced plurality of holes in the other tubular element, and said adjustment means include a pin member removably insertable through the aligned holes in said first and second tubular elements to prevent relative axial movement between said first and second tubular elements.

7. The adjustable stilt of claim 6 wherein:

said pin member is a clevis pin, having a retaining hole through a first end thereof, which is positioned outside said first and second tubular elements when said clevis pin is in its inserted position, and said adjustment means further comprise retaining means removably received in said retaining hole.

8. The adjustable stilt of claim 7 wherein:

said retaining means comprise a ring.

9. The adjustable stilt of claim 7 wherein:

said retaining means comprise a cotter key.

10. The adjustable stilt of claim 5 wherein:

said adjustment means is further operative to removably secure said step to said first and second tubular elements.

11. Stilt apparatus having enhanced user safety and foot stability, said stilt apparatus comprising:

an elongated pole structure positionable in a generally vertically extending operating orientation in which a lower end of said pole structure is engageable with a horizontal support surface such as the ground; and a step member, secured to said pole structure and positioned upwardly of its lower end, upon which a user of said stilt apparatus may stand, on one foot, when said pole structure is in its operating orientation, said step member including:

a first portion having a length extending transversely to said pole structure in a first direction, an inner end adjacent said pole structure, an outer end positioned outwardly of said inner end, and an essentially flat upper side surface adapted to engage and support the bottom of the user's foot, and a second portion extending upwardly from said inner end of said first portion along a side portion of said pole structure, said second portion having an essentially flat outer side surface which faces in said first direction and extends substantial distances laterally beyond opposite sides of said pole structure, said outer side surface defining on said step member a horizontally extended bracing surface against which a side of the user's foot may be placed to substantially inhibit undesirable relative pivoting between the user's foot and the pole structure, about a generally vertical axis, during use of said stilt apparatus.

* * * * *